US007240630B2

(12) United States Patent
Akers

(10) Patent No.: US 7,240,630 B2
(45) Date of Patent: Jul. 10, 2007

(54) GYROSTABILIZER FOR SMALL BOATS

(75) Inventor: Richard H. Akers, Portland, ME (US)

(73) Assignee: Marine Motion Control, LLC, Portland, ME (US)

( * ) Notice: Subject to any disclaimer, the term of this patent is extended or adjusted under 35 U.S.C. 154(b) by 268 days.

(21) Appl. No.: 10/958,562

(22) Filed: Oct. 4, 2004

(65) Prior Publication Data

US 2005/0076726 A1 Apr. 14, 2005

Related U.S. Application Data

(60) Provisional application No. 60/509,653, filed on Oct. 8, 2003.

(51) Int. Cl.
*B63B 39/00* (2006.01)

(52) U.S. Cl. ..... 114/122

(58) Field of Classification Search ..... 114/122; 74/5.22, 5.47

See application file for complete search history.

(56) References Cited

U.S. PATENT DOCUMENTS

| | | | | |
|---|---|---|---|---|
| 769,493 | A | 9/1904 | Schlick | |
| 769,693 | A | 9/1904 | Forbes | |
| 874,255 | A | 12/1907 | Skutsch | |
| 1,150,311 | A | 8/1915 | Sperry | |
| 1,232,619 | A | 7/1917 | Sperry | |
| 1,236,204 | A | 8/1917 | Norden | |
| 1,475,460 | A | 11/1923 | Schein et al. | |
| 1,640,549 | A | 8/1927 | Lamme | |
| 3,576,134 | A | 4/1971 | Fersht | |
| 4,176,563 | A | 12/1979 | Younger | |
| 5,511,504 | A * | 4/1996 | Martin | 114/61.12 |
| 5,628,267 | A | 5/1997 | Hoshio et al. | |
| 5,778,735 | A | 7/1998 | Groves | |
| 5,839,386 | A | 11/1998 | Frieling et al. | |

(Continued)

OTHER PUBLICATIONS

Rist, Caroline, Flywheel Electromechanical Batteries, NASA Glenn Research Center, TOP3-00014, Oct. 27, 1999.

(Continued)

*Primary Examiner*—Jesús D Sotelo
(74) *Attorney, Agent, or Firm*—Verrill Dana, LLP; Chris A. Caseiro

(57) ABSTRACT

A gyrostabilizer system that counteracts the natural rolling motion of a small boat or vessel. The invention constitutes an improvement in prior art systems of this type in that the system weighs less because it has a much lighter rotor made of composite materials spinning at much higher speeds. The gyrostabilizer system includes a lightweight rotor spinning at very high speeds to attain a large angular momentum. The mass of the rotor is concentrated away from the spin axis of the rotor to maximize angular momentum while minimizing weight. The rotor is mounted in a frame that, in turn, is mounted on gimbals so that the frame can be rotated about an axis that is normal to the longitudinal roll axis of the vessel. When the rotor is rotated about the gimbals, a torque is created that opposes the torque created by the sea and reduces the rolling motion of the vessel. The rotor may be mounted in an evacuated chamber to reduce air drag. Rotation of the rotor frame around the gimbal axis is controlled by an active servo system using information provided by roll angular position and angular velocity sensors.

25 Claims, 9 Drawing Sheets

U.S. PATENT DOCUMENTS

| | | | |
|---|---|---|---|
| 5,873,560 | A | 2/1999 | Sendar, Jr. et al. |
| 6,014,911 | A | 1/2000 | Swett |
| 6,122,993 | A | 9/2000 | Morris et al. |
| 6,262,505 | B1 | 7/2001 | Hockney et al. |
| 6,360,838 | B1 | 3/2002 | Kulhavy |
| 6,568,291 | B1 | 5/2003 | Inman |
| 6,727,616 | B1 | 4/2004 | Gabrys et al. |
| 6,973,847 | B2 * | 12/2005 | Adams et al. ..... 74/5.47 |
| 2003/0029367 | A1 | 2/2003 | Katsuya et al. |

OTHER PUBLICATIONS

Sea Gyro Pty. Ltd. of Bibra Lake, Western Australia, website www.webace.com.au/~sea_gyro; various dates and including description of ship gyroscope stabilization.

* cited by examiner

GYROSTABILIZER FOR SMALL BOATS

CROSS REFERENCE TO RELATED APPLICATION

The present application claims the priority benefit of U.S. provisional patent application Ser. No. 60/509,653, filed Oct. 8, 2003, entitled "GYROSTABILIZER FOR SMALL BOATS" of the same named inventor. The entire contents of that prior application are incorporated herein by reference.

BACKGROUND OF THE INVENTION

1. Field of the Invention

The present invention relates to systems and devices for stabilizing boats and small ships. More particularly, the present invention relates to gyroscopic stabilizers positioned in boats and configured to counteract rolling motion caused by waves and ship wakes. The gyroscopic stabilizer of the present invention is an active stabilization device.

2. Description of the Prior Art

A rolling boat is uncomfortable and can cause people and animals to experience motion sickness. A device that can create an anti-roll torque can be used to oppose this motion. The difficulty with creating such a device is that a boat is not resting on or in a solid medium that can be used as a base to create an anti-rolling moment. One solution to this problem is to use a large gyroscope to stabilize the boat. A gyroscope is a rotor spinning at a high speed around its spin axis, mounted in a frame that can be moved as the user wishes. When the spinning wheel is turned around an axis (gimbal axis) that is at right angles to its spin axis, a torque is generated around a third axis that is perpendicular to both the spin axis and the turning axis. A gyrostabilizer creates a torque or moment that reduces rolling motion. The gyrostabilizer has a rotor whose spin axis is nominally vertical. The rotor frame is mounted on gimbals so that the rotor can rotate about a transverse, side-to-side axis, but the frame is fastened to the vessel so that the system is constrained to roll from side to side with the boat. With proper selection of the spin and gimbal axes, a torque can be created to oppose roll motion.

Gyroscopic stabilizers (gyrostabilizers) were first used to stabilize very large ships and yachts almost a century ago, and their ability to resist rolling motion (side to side rotation) is well understood. In 1913, the Sperry Gyroscope Company installed a 5-ton gyrostabilizer on the USS Worden, a 700-ton destroyer. Although the device performed as expected, the Navy stopped installing gyrostabilizers at the onset of WW I. Some gyrostabilizers were installed on private yachts in the first part of the 20th century, but other methods of stabilization supplanted gyrostabilizers in the yacht market.

The heart of a gyrostabilizer is a rotor spinning at high speeds. The rotor has three important characteristics:

Weight. The rotor is the heaviest component in the gyrostabilizer machine.

Angular Momentum. The angular (spinning) momentum of the rotor determines its ability to stabilize a yacht or small craft Kinetic Energy. The kinetic energy stored in the spinning rotor determines how long it takes to start and stop the machine.

The moment of inertia of the rotor depends on both its mass and its mass distribution. The farther mass is located from the spin axis, the higher the moment of inertia that results from the mass. The more the mass of rotor is distributed toward the outer rim of the wheel, the higher the ratio of moment of inertia to its mass.

The angular momentum of the rotor is the rotor's moment of inertia multiplied by its angular speed, and a rotor with high angular momentum can create a large anti-rolling torque. To create a lightweight rotor with a high angular momentum, the designer has to rotate it at high speeds.

The kinetic energy of a spinning rotor is proportional to its moment of inertia and to the square of its speed. The time required to start or stop the rotor is roughly proportional to its full-speed energy, or to the square of its rotation rate.

When a gyroscope is turned around an axis, called the gimbal axis, which is approximately at right angles to its spin axis, it creates a torque around a third axis, orthogonal to the first two. To create an anti-rolling gyrostabilizer, the spin axis is nominally vertical, and the spinning rotor is tipped forward or backwards on a gimbal axis in the boat. The result is a torque orthogonal to both the spin axis and the gimbal axis. Nominally this torque is aligned with the boat's roll axis, and therefore can be utilized as an anti-rolling torque. The strength of this torque depends on the angle formed by the spin axis and the gimbal axis. Assuming that the boat rotation is primarily around its roll axis, and that rotation around the boat's pitch axis is small enough to be ignored, as the tip angle increases, the included angle decreases and the anti-rolling torque decreases. Accordingly, the maximum anti-rolling restoring torque will be limited to the based on maximum gimbal angles of plus or minus ninety-degrees.

Summarizing the tradeoffs described above:

A high-speed rotor can be lighter than a low-speed rotor.

Low speed rotors can startup and shutdown using less power than high-speed rotors.

The minimum moment of inertia of the rotor is determined by the maximum anti-roll torque required by the boat. This is determined by the size of the boat and the size of the waves or wakes.

Apart from the very large scale passive gyrostabilizer developed by Sperry for Navy vessels of World War I, systems designed to stabilize vessels usually rely upon actuated appendages, such as fins, interceptors or submerged foils, to counteract the rolling effects caused by waves and wakes. Fins, interceptors, and foils all depend on significant forward motion for their anti-roll forces, and are inefficient at low speeds. Prior gyroscope-related anti-rolling systems have either been too massive for relatively smaller vessels, such as yachts, or have been confined to use as a sensing system in combination with a structural element or elements that actually do the stabilizing. There is presently an unfilled need for an effective stabilization system deployable in boats and small ships, especially boats and small ships that are stationary or moving at low speeds.

SUMMARY OF THE INVENTION

The present invention is a machine that reduces roll motion in ships, said motion caused by waves, wakes or other disturbances. The motion is reduced by sensing the roll position and velocity, and applying a torque to counteract the forces that cause the roll motion. The counter torque is created by turning a rotating drum around a secondary axis that is normal to the drum's major spin axis. The secondary axis and the ship's roll axis are normal to one another. Conventional technology for a ship stabilizer using gyroscopic stabilization uses a flywheel with a single hub to supply the necessary angular momentum. This invention incorporates a drum supported by two or more hubs, widely spaced across the spin axis. The rotor is preferably drum shaped to balance its diameter vs. its weight vs. its angular momentum. The drum rotor is mounted in a frame, which in turn is mounted on gimbals so that the rotor can nutate under the control of the system's servo system. The servo system's operation is managed by a control system having input from the ship angular position and rate sensors.

The drum is configured to have a much higher moment of inertia than a traditional flywheel. By concentrating the mass of the drum in its outer shell or fibers, the overall weight of the drum used in this invention is less than that of the flywheel used in conventional technology, while the moment of inertia is comparable or even larger. The drum spins at a rate above 5,000 Revolutions Per Minute (RPM), and preferably spins at 10,000 RPM or higher, so the angular momentum of the rotor is much higher than that of the conventional spinning flywheel. For that reason, the rotor is made of a very lightweight metal or a non-metallic material, such as a high-strength composite material. In particular, the rotor is constructed of one or more composite materials, preferably fiber-reinforced plastic or ceramic.

With the rotor in its nominal position, the counter torque is proportional to the angular momentum of the spinning object, multiplied by the angular velocity of the entire mechanism around the secondary axis. This invention can create a larger counter roll torque than the conventional technology because the angular momentum of the machine is much larger than that of a conventional machine. Conventional technology for a ship stabilizer using gyroscopic stabilization includes a flywheel drive motor system whose speed is determined by a constant voltage. This invention uses motor controlled by an active servo system. The active control system reduces the time required for the drum to spin up to operating speed and to spin down to a full stop, when compared to the times that would be obtained using a constant voltage drive motor.

Conventional technology for a ship stabilizer using gyroscopic stabilization includes a flywheel spinning in ambient air, and during full-speed operation most of the rotor energy loss comes from air drag. The rotating drum in this invention is enclosed in a chamber with reduced air pressure, reducing the energy required to operate the machine. This chamber also acts as a protective shroud, so that failures in the rotor will be contained in the shroud chamber.

This invention includes sensors to measure the ship roll and pitch angles and rates. This invention includes active servo control of the frame gimbal's position. The torque applied to the gimbal is generated by a servo amplifier whose input is a function of the measured ship roll and pitch angles and rates, and of the gimbal's angular position and velocity.

Conventional technology for a ship stabilizer using gyroscopic stabilization incorporates passive or semi-passive control of the gimbal's position of the rotor frame, wherein the rotation of the rotor frame around its gimbals is reduced by fluid, magnetic or drum brakes, possibly as a simple function of the ship roll angular velocity. A much larger percentage reduction in ship roll motion can be much obtained using the active control system of this invention as compared to the passive or semi-passive control system of conventional technology.

The present invention fills the need for a stabilization system that may be used to counteract rolling caused by wave and wake action. The invention is an active gyrostabilizer that fits within the dimensions of a boat or small ship and achieves reasonable stabilization under the majority of sea conditions experienced by boats and small ships. The gyrostabilizer of this invention includes a rotor rotated by a rotor motor that is actively controlled by a motor control system. As indicated, in addition to regulating and generating rotor spin, the rotor motor and the motor control system act as a rotor braking system so that the gyrostabilizer can be spun down quickly as needed. The system of the present invention also preferably includes one or more angular rate sensors and one or more inclinometers to sense the exact roll position and angular velocity. In particular, solid-state angular inclinometers and rate sensors can be used to sense the boat's motion. The active control system uses information from the sensors to drive the gimbal's servomotor to control the gyrostabilizer's gimbal angle.

The rotor/frame system preferably is mounted in the vessel to orient the rotor so that the vessel roll axis, the nominal spin axis and the gimbal axis are orthogonal. This can be accomplished in two different ways. First, by having the rotor nominal spin axis be vertical and the frame gimbal's axis be athwartships, or second, by having the rotor nominal spin axis be athwartships (side-to-side) and the frame gimbal's axis be vertical. In the first case, the vessel's roll motion primarily is converted to pitching motion, which is resisted by the long, slender nature of boats. In the second case the roll motion primarily is converted to yaw (turning) motion. As a vessel's pitching motion faces more resistance than does its yaw motion, the preferred orientation is the first case. The equations that describe the rotor motion in the first orientation case are:

$$\begin{bmatrix} L_C \\ M_M \\ N_C \end{bmatrix} = \begin{bmatrix} qI_{R_Z}\omega_R\cos\theta - rI_{R_Y}\theta' \\ rI_{R_Z}\omega_R\sin\theta - pI_{R_Z}\omega_R\cos\theta \\ pI_{R_Y}\theta' - qI_{R_Z}\omega_R\sin\theta \end{bmatrix} + \begin{bmatrix} I_{R_Z}\omega'_R\sin\theta + I_{R_Z}\omega_R\theta'\cos\theta \\ I_{R_Y}\theta'' \\ I_{R_Z}\omega'_R\cos\theta - I_{R_Z}\omega_R\theta'\sin\theta \end{bmatrix}$$

Where:

p, q, and r are roll, pitch and yaw angular rates

J is the gyrostabilizer rotor moment of inertia about its main spin axis

I is the gyrostabilizer rotor moment of inertia about either off axis $M_M$ is the torque applied to the gimbal frame $L_C$ and $N_C$ are the roll and yaw torques, applied by the gyrostabilizer to the vessel θ, θ', θ" are the rotor gimbal angle, rotation rate and rotation acceleration with respect to the vessel $\omega_R$ is the scalar-valued rotational rate of the rotor.

This equation indicates that the rotor creates a moment ($L_C$) that opposes the roll motion of the vessel. The angular momentum is large and fixed, so the rate of gimbal rotation can be used to control the anti-roll force. Observing the general equation, the anti-roll force becomes vanishingly small when the gimbal angle reaches −90 degrees or +90 degrees, so the active controller limits the gimbal range to avoid this condition.

The gyrostabilizer includes an active servo control system for controlling the gyroscope gimbal angle. The mass of the rotor is concentrated away from its primary spin axis to minimize weight while maximizing angular momentum. The high-speed rotor around its gimbal axis may be dampened with a passive damping system or may be controlled by an active servo system. The active servo control system for the rotor gimbal's axis may be of the PID type and may include a stepped gain function to compensate for the non-linear characteristics of the gyrostabilizer.

The details of one or more examples related to the invention are set forth in the accompanying drawings and the description below. Other features, objects, and advantages of the invention will be apparent from the description, the drawings, and the appended claims.

DETAILED DESCRIPTION OF THE PREFERRED EMBODIMENTS

Figure 1:
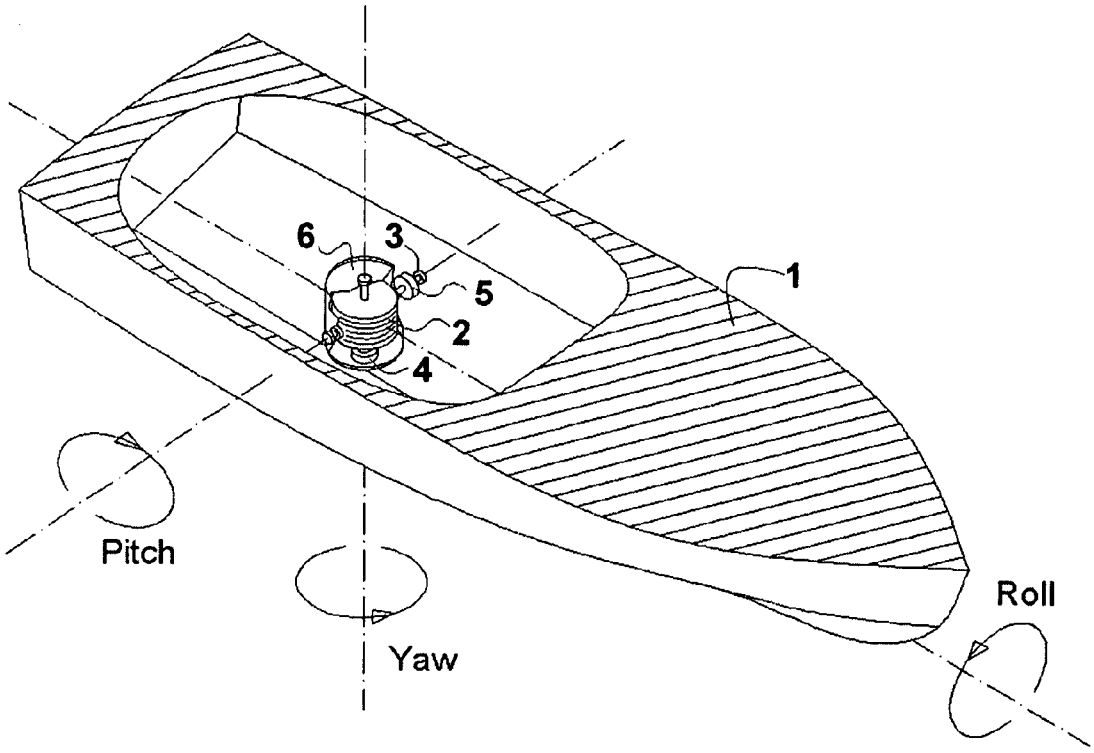
FIG. 1 is a perspective view of a first embodiment of the gyrostabilizer system of the present invention as installed in a simplified representation of a vessel.

In reference to FIG. 1, a gyrostabilizer system of the present invention is shown positioned within a ship. In operation, motor (4) spins the gyrostabilizer drum (2) at constant, high speeds. The drum spins in bearings in the shroud (6). The shroud, drum and spin motor assembly has gimbals (3), and the gimbals are mounted to the boat (1). Angular motion of the shroud, drum and spin motor assembly around the gimbal axis is controlled by servo motor (5). In this embodiment the gimbal axis is coincident or parallel with the pitch axis of the boat or ship (1).

Figure 2:
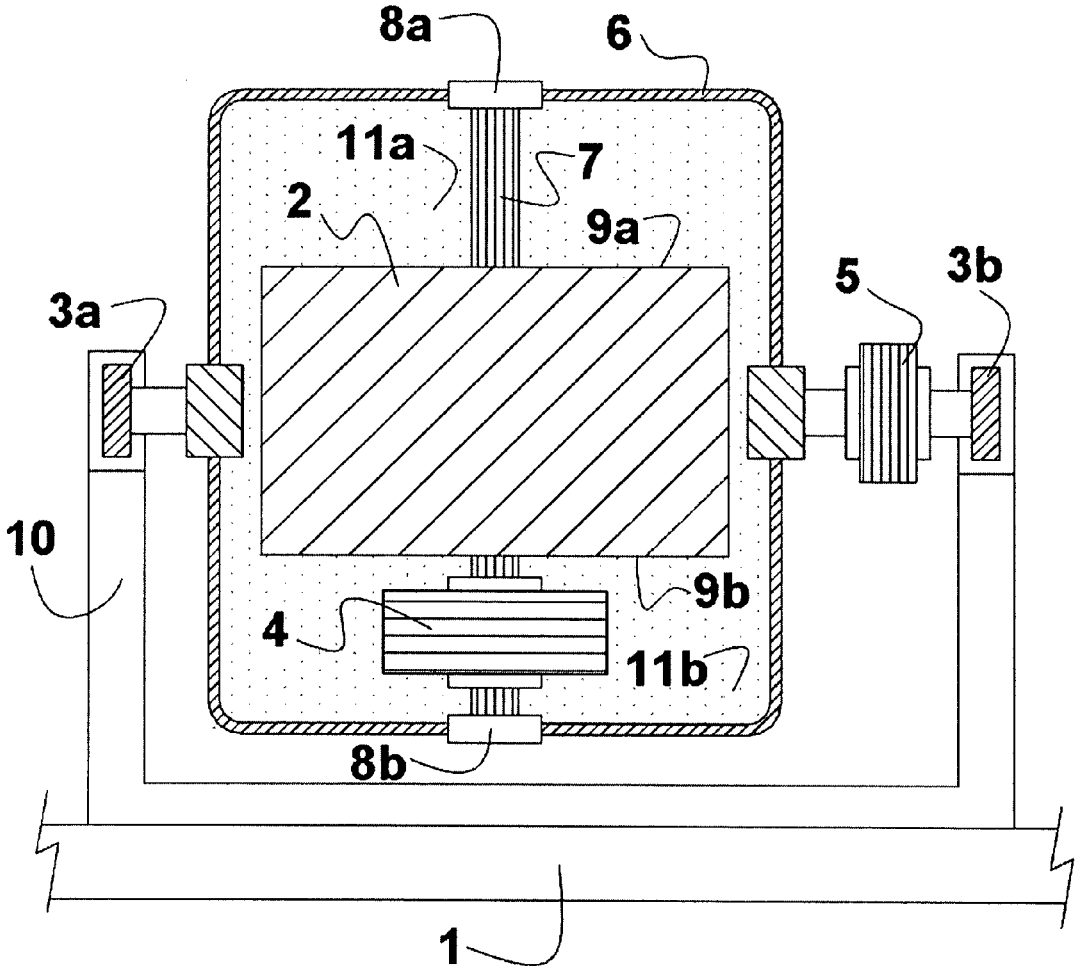
FIG. 2 is a cross sectional view of the gyrostabilizer system of the present invention.

In reference to FIG. 2, drum (2) is connected to axle (7) by end caps (9*a*) and (9*b*). The axle (7) is mounted on bearings (8*a*) and (8*b*). Motor (4) drives the drum to very high angular velocities. The motor/drum assembly is contained in a protective shroud (6), and the bearings (8*a*) and (8*b*) are mounted to the shroud assembly. The space (11*a*) and (11*b*) inside the shroud is partially evacuated to reduce air drag. The shroud assembly is mounted to the support structure (10) on gimbals (3*a*) and (3*b*) on an axis perpendicular to the drum spin axis. The shroud assembly rotates on the gimbal axis under the control of servo motor (5). Roll angle and roll rate are measured by sensors and information from these sensors is input to an active controller that drives the servo motor. The support structure (10) is securely fastened to the boat or ship (1).

Figure 3:
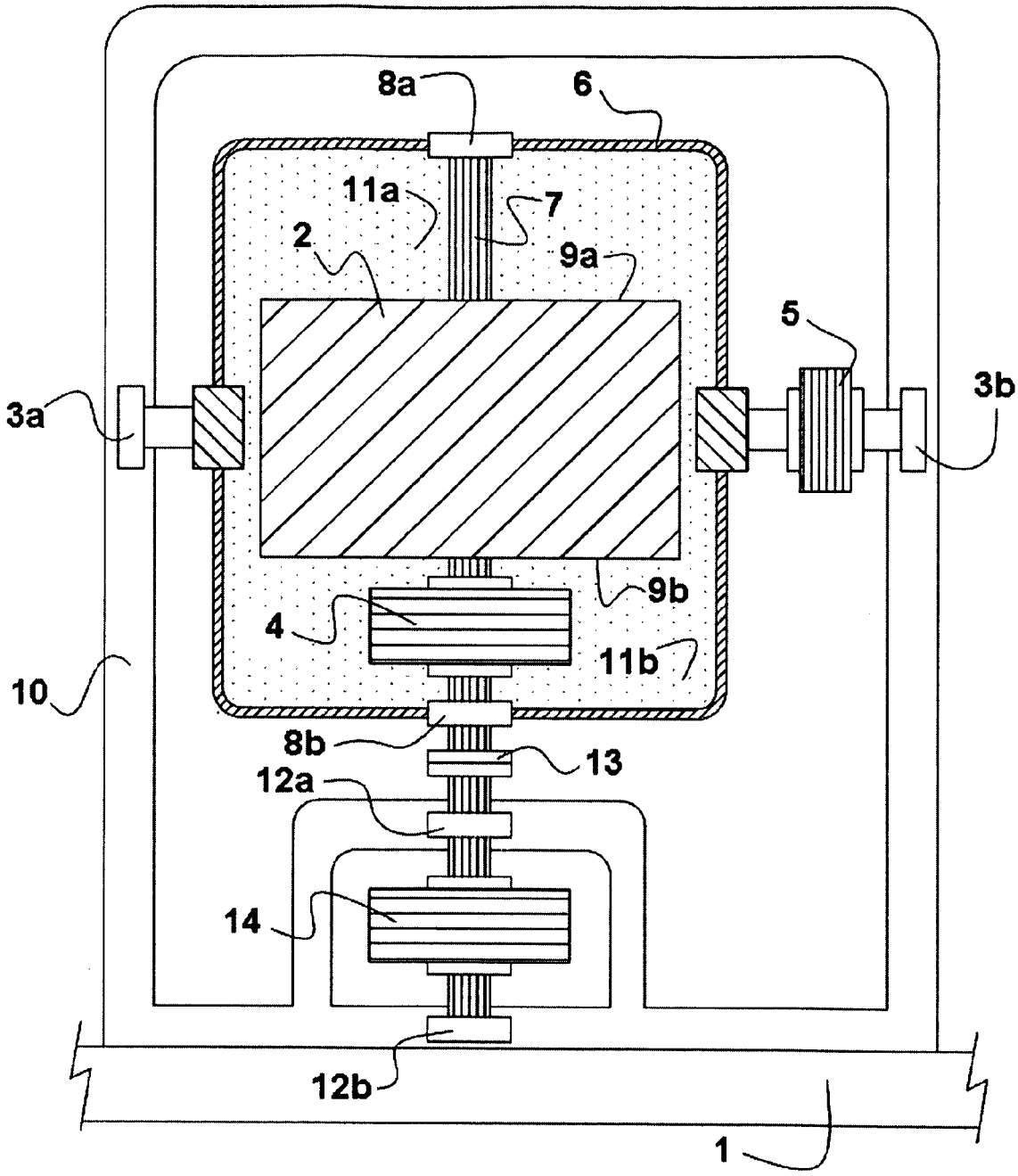
FIG. 3 is a cross sectional view of the gyrostabilizer system of the present invention in which the vacuum and containment shroud is separated from the structural shroud, and in which two drum rotor motors are used.

In reference to FIG. 3, drum (2) is connected to axle (7) by end caps (9*a*) and (9*b*). The axle (7) is mounted on bearings (8*a*) and (8*b*). Motor (4) is in series with motor (14). Motor (14) is engaged through clutch assembly (13) and can be connected to the drum during the startup and shutdown cycles. Motor (14) is engaged during the phase of operation in which the drum is spinning slowly and is disengaged during the final phase in which the drum spins up to very high angular velocities. The axle segment for motor (14) is mounted on bearings (12*a*) and (12*b*). The motor/drum assembly is contained in a protective and vacuum shroud (6), and the bearings (8*a*) and (8*b*) are mounted to the shroud assembly. The space (11*a*) and (11*b*) inside the shroud is partially evacuated to reduce air drag. The shroud assembly is mounted on gimbals (3*a*) and (3*b*) on an axis perpendicular to the drum spin axis. The shroud assembly rotates on the gimbal axis under the control of servo motor (5). Roll angle and roll rate are measured by sensors and information from these sensors is input to an active controller that drives the servo motor. The rotor assembly is supported by bearings (3*a*) and (3*b*) on the gimbal axis, and the rotor assembly is mounted in a structural and safety shroud (10). Support shroud (10) is fastened securely to the boat or ship (1).

Figure 4:
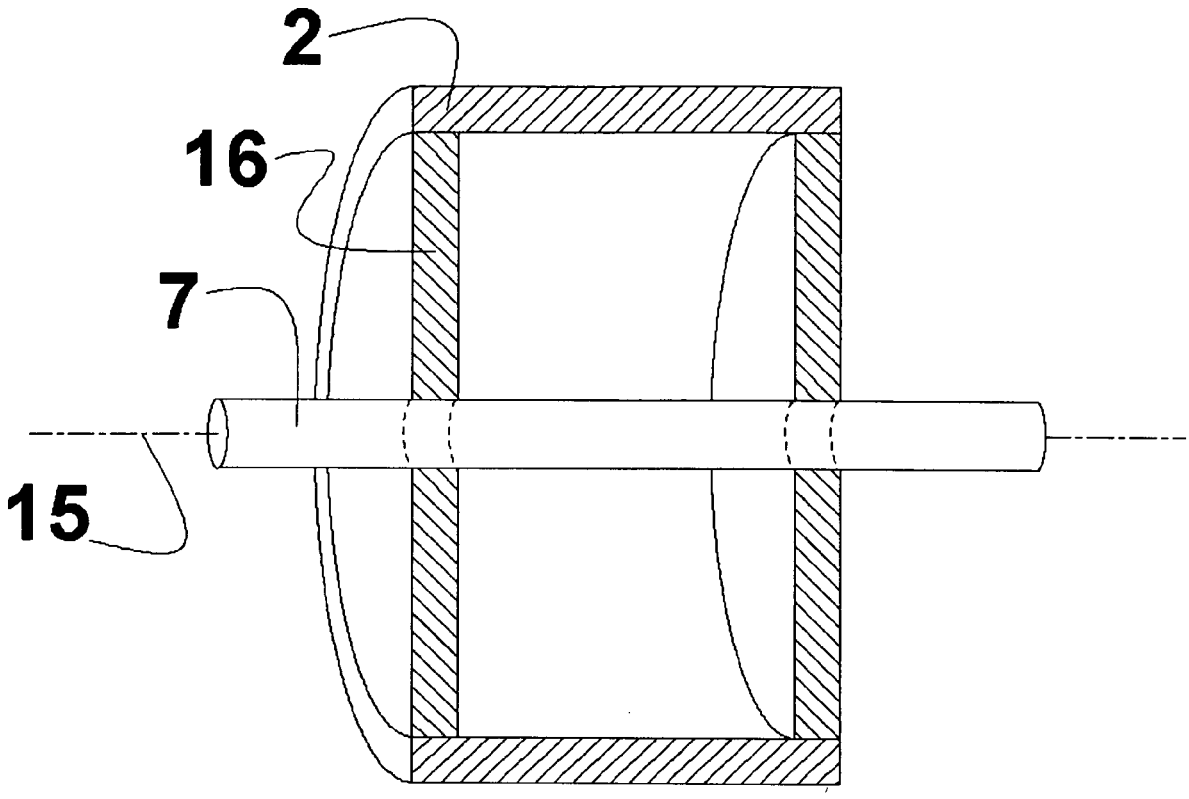
FIG. 4 is a cross sectional view of a first embodiment of the drum rotor of the gyrostabilizer system of the present invention.

In reference to FIG. 4, a first embodiment of the drum (2) is fastened to axle (7) by webs (16). A web is a radial plate such as the end caps of a drum, whose purpose is to attach the outer drum surface to the axle. The axle/drum assembly spins around axis (15). The drum (2) is larger than the inner webs (16), which are attached inside the ends of the drum.

Figure 5:
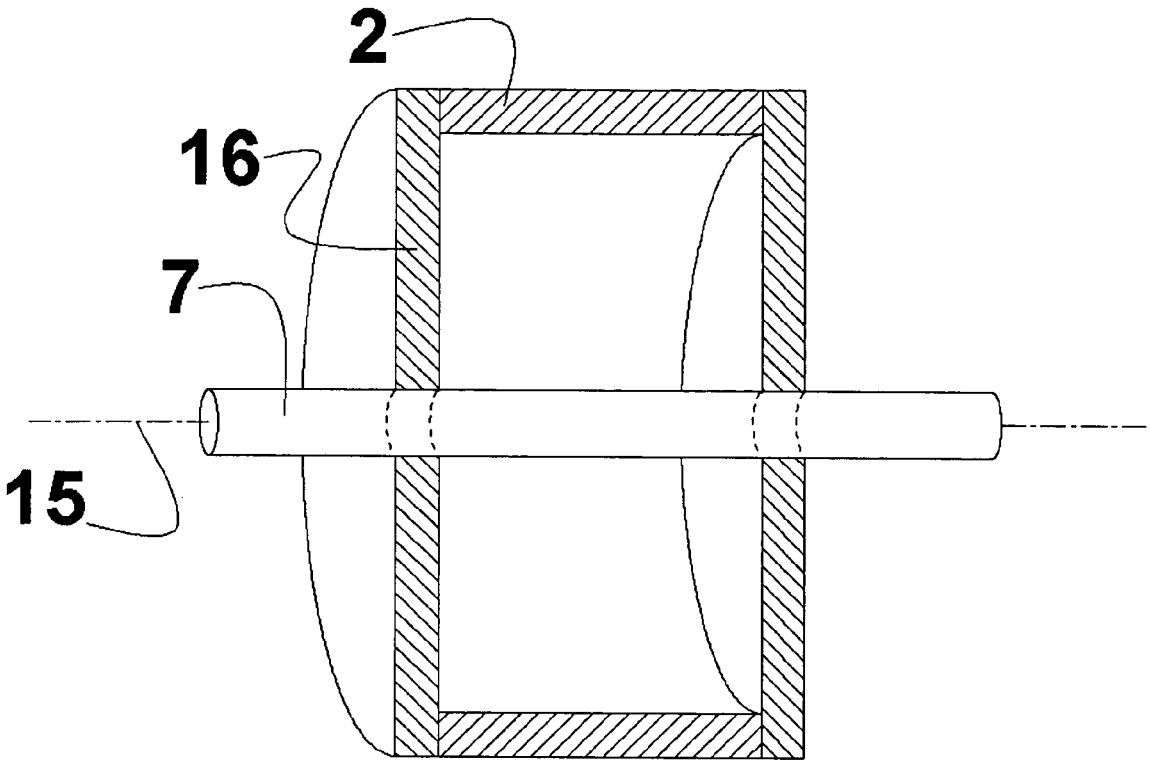
FIG. 5 is a cross sectional view of a second embodiment of the drum rotor of the gyrostabilizer system of the present invention.

In reference to FIG. 5, a second embodiment of the drum (2) is fastened to axle (7) by webs (16). The axle/drum assembly spins around axis (15). The web (16) is the same diameter as the drum (2), and the drum spans the space between webs.

Figure 6:
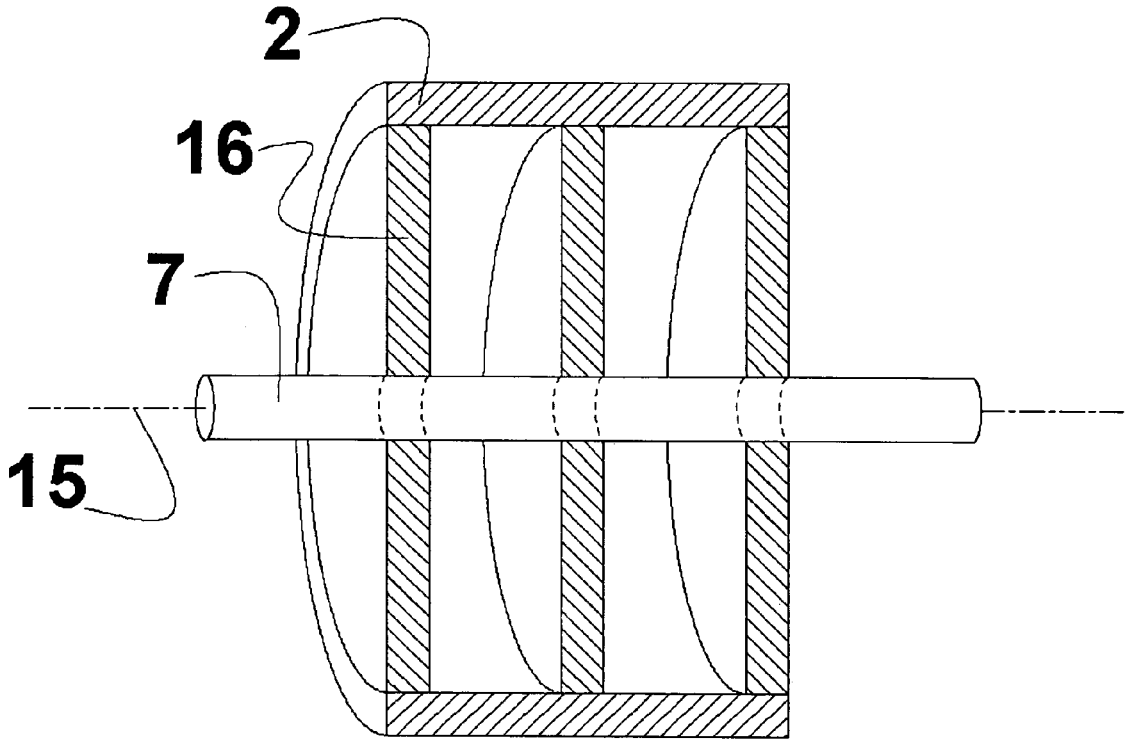
FIG. 6 is a cross sectional view of a second embodiment of the drum rotor of the gyrostabilizer system of the present invention.

In reference to FIG. 6, a third embodiment of the drum (2) is fastened to axle (7) by three or more webs (16). The axle/drum assembly spins around axis (15). The drum (2) is larger than the inner webs (16), which are attached inside the drum.

Figure 7:
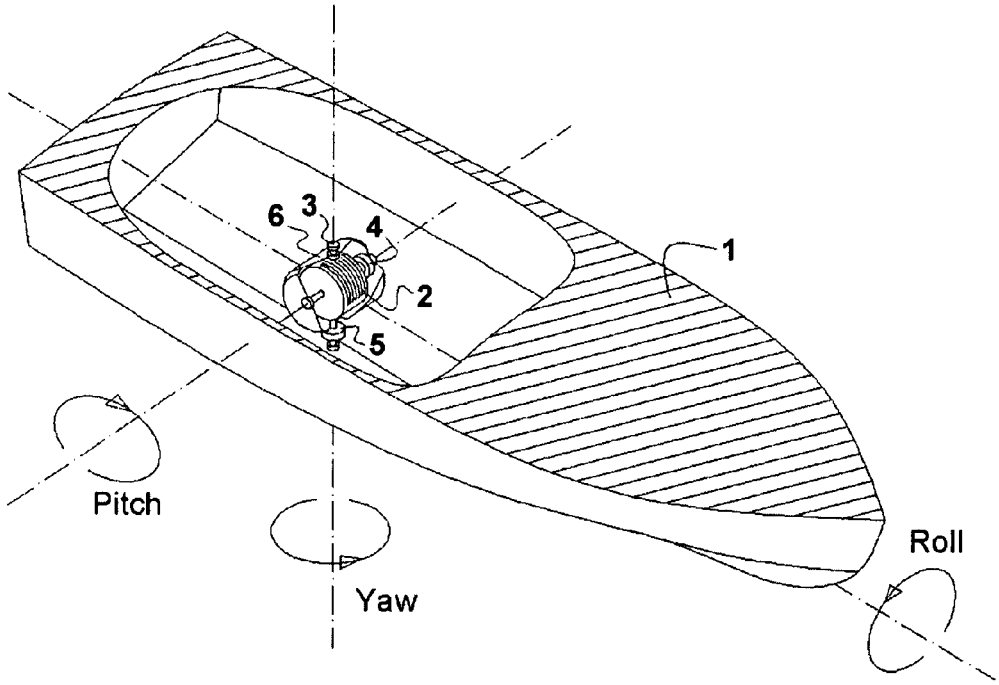
FIG. 7 is a perspective view of a second embodiment of the gyrostabilizer system of the present invention as installed in a simplified representation of a vessel.

In reference to FIG. 7, in a second embodiment of the gyrostabilizer system of the present invention, the motor (4) again spins the gyrostabilizer drum (2) at constant, high speeds and the drum spins in bearings in the shroud (6). The shroud, drum and spin motor assembly has gimbals (3), and the gimbals are mounted to the boat (1). Angular motion of the shroud, drum and spin motor assembly around the gimbal axis is controlled by servo motor (5). Roll angle and roll rate are measured by sensors and information from these sensors is input to an active controller that drives the servo motor. In this embodiment the gimbal axis is coincident or parallel with the yaw axis of the boat or ship (1).

Figure 8:
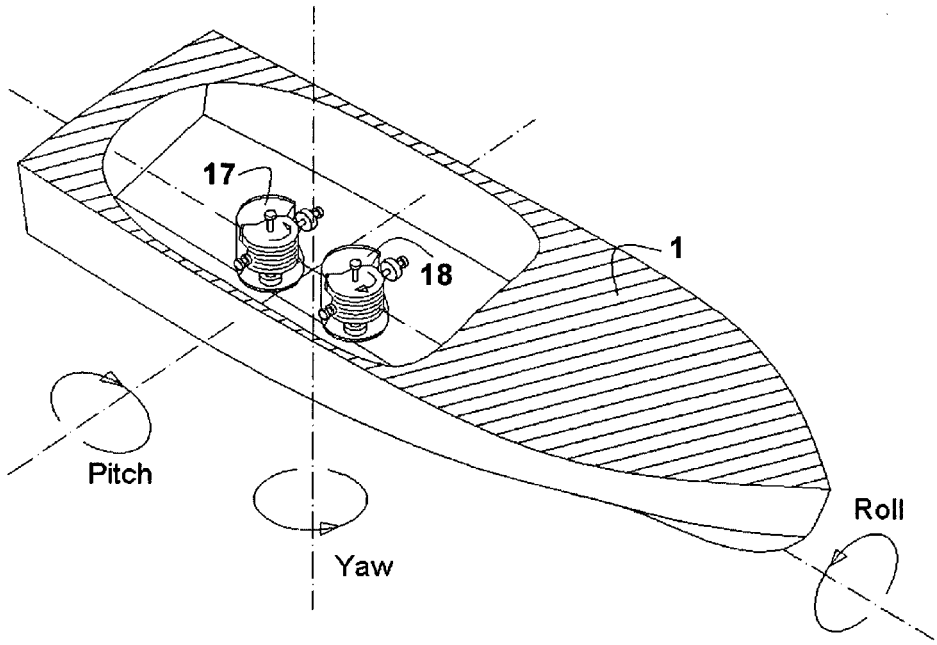
FIG. 8 is a perspective view of a third embodiment of the gyrostabilizer system of the present invention as installed in a simplified representation of a vessel.

In reference to FIG. 8, in a third embodiment of the gyrostabilizer system of the present invention, two gyrostabilizers, (17) and (18), are mounted in boat (1) so that the drum rotor spin axes are nominally vertical. The drum rotor in gyrostabilizer (17) spins in the opposite direction from the drum rotor in gyrostabilizer (18). In response to roll motion and angular velocity, the torque applied to the gyrostabilizers will be in the opposite direction, so that the two corrective torques cancel each other. This embodiment can offset the roll torque without inducing a pitching torque.

Figure 9:
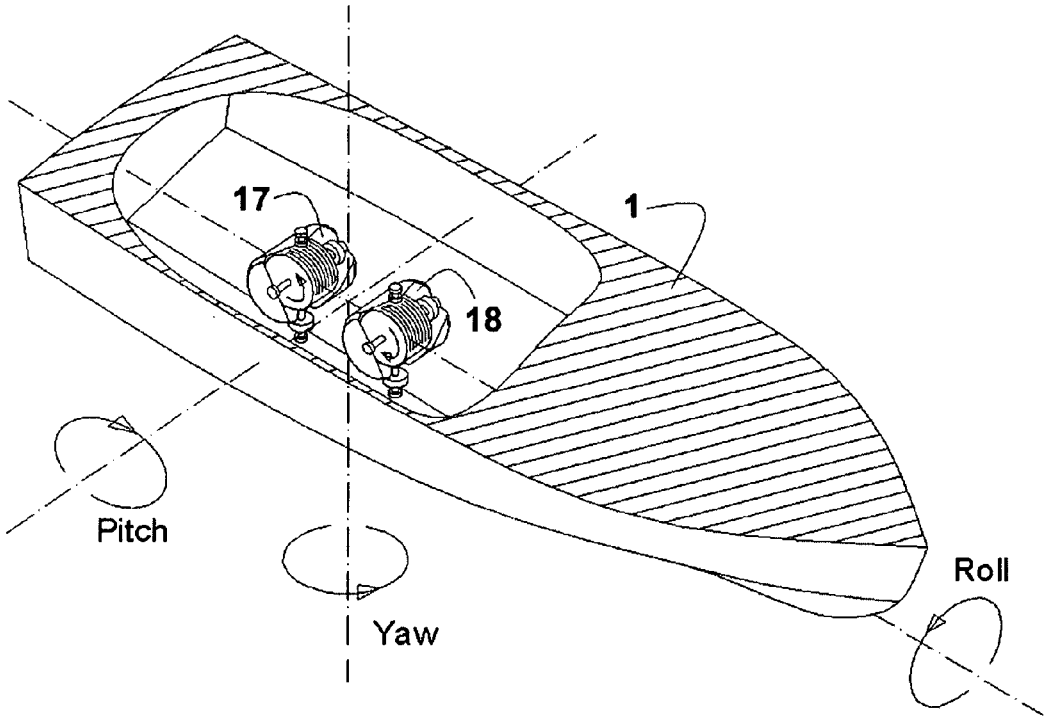
FIG. 9 is a perspective view of a fourth embodiment of the gyrostabilizer system of the present invention as installed in a simplified representation of a vessel.

In reference to FIG. 9, in a fourth embodiment of the gyrostabilizer system, two gyrostabilizers, (17) and (18), are also mounted in boat (1) so that the drum rotor spin axes are nominally transverse. The drum rotor in gyrostabilizer (17) spins in the opposite direction from the drum rotor in gyrostabilizer (18). In response to roll motion and angular velocity, the torque applied to the gyrostabilizers will be in the opposite direction, so that the two corrective torques cancel each other. This embodiment can offset the roll torque without inducing a yawing torque.

A fifth embodiment of the gyrostabilizer system is the same as the first embodiment shown in FIG. 1, with the addition of a roll angle accelerometer. Information from the roll angle position, angular rate and angular acceleration are used by the control system to control the gimbal servo motor.

A sixth embodiment of the gyrostabilizer system is the same as the second embodiment shown in FIG. 7, with the addition of a roll angle accelerometer. Information from the roll angle position, angular rate and angular acceleration are used by the control system to control the gimbal servo motor.

A fourth embodiment of the drum is that the drum and supporting webs are built as one continuous component using filament-wound composite construction.

What is claimed is:

1. A method to reduce the rolling motion of a ship comprising the steps of:

a. sensing roll angle and rate of the ship;

b. calculating vector forces on the ship from the sensed roll angle and rate;

c. securing a gyrostabilizer to the ship, wherein the sensing of roll angle and rate of the ship is performed by one or more devices independent of the gyrostabilizer; and d. applying an actively controlled torque through the gyrostabilizer to counteract the calculated vector forces.

2. The method as claimed in claim 1 wherein the gyrostabilizer includes a rotor having a major spin axis and wherein the step of applying an actively controlled torque includes the step of:

turning the rotor around a secondary axis that is normal to the major spin axis, and normal to a roll axis of the ship.

3. The method as claimed in claim 1 further comprising the step of sensing pitch angle.

4. A system to reduce the rolling motion of a ship, the system comprising:

a. a support structure affixable to the ship;

b. one or more pairs of gimbals connected to the support structure;

c. a shroud containing a rotor therein and connected to the one or more pairs of gimbals;

d. a rotor motor coupled to the rotor for rotating the rotor;

e. a servo motor connected to a gimbal for rotating the shroud;

f. one or more sensors for sensing roll angle and rate of the ship; and g. active control means for receiving information from the one or more sensors and regulating operation of the servo motor based on the received information.

5. The system as claimed in claim 4 wherein the shroud containing the rotor includes a space therein, and wherein the space within the shroud is partially evacuated.

6. The system as claimed in claim 4 wherein the rotor motor can spin the rotor to high angular velocities.

7. The system as claimed in claim 6 wherein the rotor motor can spin the rotor at a rate of 5000 revolutions per minute or higher.

8. The system as claimed in claim 4 wherein the active control means includes a servo amplifier to regulate rotation of the servo motor.

9. The system as claimed in claim 4 wherein the shroud is positioned on the one or more gimbal pairs on an axis that is substantially perpendicular to the axis of spin of the rotor.

10. The system as claimed in claim 4 wherein the rotor motor is positioned within the shroud.

11. The system as claimed in claim 4 wherein the rotor motor is positioned external to the shroud.

12. The system as claimed in claim 4 further comprising a second rotor motor exterior to the shroud and a clutch assembly connected to the second rotor motor to control engagement of the second rotor motor with the rotor such that the second rotor motor is engaged for slow rotor spinning and disengaged for rotor spinning at high angular velocities.

13. The system as claimed in claim 4 wherein the rotor is a rotatable drum.

14. The system as claimed in claim 13 wherein the rotatable drum is connected to the rotor motor by an axle, and wherein the rotatable drum is connected to the axle by a plurality of webs, the plurality of webs being attached to an interior of the drum.

15. The system as claimed in claim 13 wherein the rotatable drum is connected to the rotor motor by an axle, and wherein the rotatable drum is connected to the axle by a plurality of webs, the plurality of webs having the same outer dimensions as the drum.

16. The system as claimed in claim 4 wherein the axes of the one or more pairs of gimbals are coincident with the yaw axis of the ship.

17. The system as claimed in claim 4 wherein the rotor is formed of a fiber-reinforced plastic laminated from fiber cloth.

18. The system as claimed in claim 4 wherein the rotor is formed by winding fibers in a plastic binder to form a filament-wound structure.

19. The system as claimed in claim 4 wherein the rotor is formed of ceramic materials.

20. The system as claimed in claim 4 wherein the active control means is a PID active servo control system.

21. The system as claimed in claim 4 wherein the active control means includes a stepped gain function to compensate for non-linear characteristics.

22. A system to reduce the rolling motion of a ship, the system comprising:

a. a first gyrostabilizer assembly affixable to the ship, the first gyrostabilizer assembly including a first shroud including a first rotor therein, a first rotor motor for rotating the first rotor, a first gimbal pair connected to the first shroud, and a first servo motor for rotating the first gimbal pair;

b. a second gyrostabilizer assembly affixable to the ship and spaced from the first gyrostabilizer assembly, the second gyrostabilizer assembly including a second shroud including a second rotor therein, a second rotor motor for rotating the second rotor, a second gimbal pair connected to the second shroud, and a second servo motor for rotating the second gimbal pair;

c. one or more sensors for sensing roll angle and rate of the ship; and d. active control means for receiving information from the one or more sensors and regulating operation of the first servo motor and the second servo motor based on the received information.

23. The system as claimed in claim 22 wherein the first rotor and the second rotor are oriented substantially vertical with respect to the ship, and wherein the first rotor is configured to spin in a first direction and the second rotor is configured to spin in a second direction opposite of the first direction.

24. The system as claimed in claim 22 wherein the first rotor and the second rotor are oriented substantially transverse with respect to the ship, and wherein the first rotor is configured to spin in a first direction and the second rotor is configured to spin in a second direction opposite of the first direction.

25. The system as claimed in claim 22 wherein a first space inside the first shroud and a second space inside the second shroud are partially evacuated.

* * * * *